US010665373B2

(12) United States Patent
Pessina et al.

(10) Patent No.: US 10,665,373 B2
(45) Date of Patent: May 26, 2020

(54) COIL ACTUATOR FOR LV OR MV APPLICATIONS

(71) Applicant: ABB S.p.A., Milan (IT)

(72) Inventors: Davide Pessina, Monza (IT); Luca Lanzoni, Bergamo (IT)

(73) Assignee: ABB S.P.A., Milan (IT)

( * ) Notice: Subject to any disclaimer, the term of this patent is extended or adjusted under 35 U.S.C. 154(b) by 272 days.

(21) Appl. No.: 15/456,549

(22) Filed: Mar. 12, 2017

(65) Prior Publication Data

US 2017/0263366 A1 Sep. 14, 2017

(30) Foreign Application Priority Data

Mar. 14, 2016 (EP) ..... 16160102

(51) Int. Cl.
*H01F 7/18* (2006.01)
*H01F 7/06* (2006.01)
(Continued)

(52) U.S. Cl.
CPC ..... *H01F 7/18* (2013.01); *H01F 7/064* (2013.01); *H01F 7/081* (2013.01); *H01F 7/1805* (2013.01); *H01H 47/325* (2013.01); *H01H 83/10* (2013.01)

(58) Field of Classification Search
CPC . H01F 7/18; H01F 7/081; H01F 7/064; H01F 7/1805; H01H 7/325
(Continued)

(56) References Cited

U.S. PATENT DOCUMENTS 4,032,823 A * 6/1977 Arvisenet ..... H01F 7/1833 361/194
4,578,734 A * 3/1986 Delbosse ..... H01H 47/02 361/152
(Continued)

FOREIGN PATENT DOCUMENTS

CN 102761096 A 10/2012
EP 0562908 A1 9/1993
(Continued)

OTHER PUBLICATIONS

WO97/40509; Schnetder Electric; Guernneur Yves; Oct. 30, 1997; Abstract; Figures, p. 2 to p. 4. (Year: 1997).*
(Continued)

*Primary Examiner* — Dharti H Patel
(74) *Attorney, Agent, or Firm* — Taft Stettinius & Hollister LLP; J. Bruce Schelkopf

(57) ABSTRACT

The present application relates to a coil actuator for low and medium voltage applications, which comprise a electromagnet operatively associated with a movable plunger, a power & control unit electrically connected with the electromagnet and first and second input terminals (T1, T2) operatively connected with the power & control unit, wherein an input voltage (VIN) is applied between the first and second input terminals during the operation of the coil actuator. The power & control unit is adapted to provide subsequent launch pulses of drive current (IC) to the electromagnet, which are separated in time by at least a predetermined time interval (TI), in response to subsequent transitions of the input voltage (VIN) from values lower than the first threshold voltage (VTH1) to values higher than the first threshold voltage.

20 Claims, 13 Drawing Sheets

Figure 1:
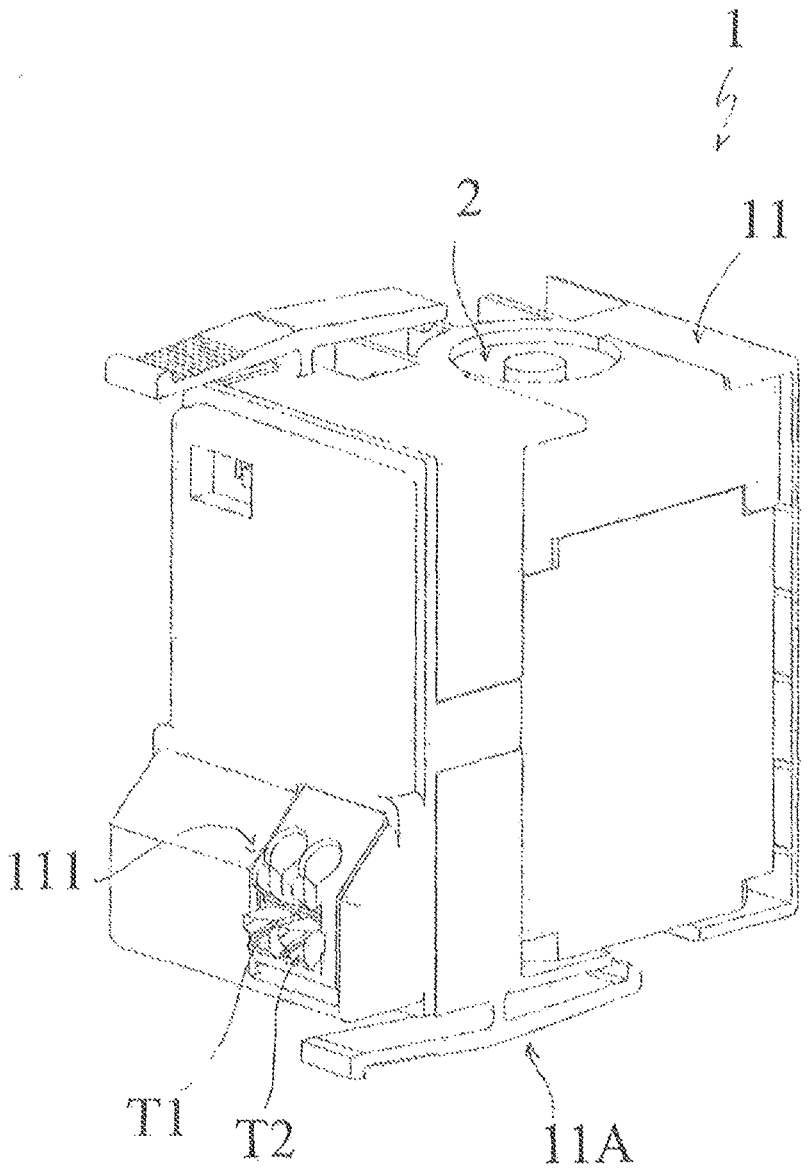

(51) Int. Cl.
*H01F 7/08* (2006.01)
*H01H 47/32* (2006.01)
*H01H 83/10* (2006.01)

(58) Field of Classification Search
USPC ..... 361/153
See application file for complete search history.

(56) References Cited

U.S. PATENT DOCUMENTS

| | | | | |
|---|---|---|---|---|
| 5,815,362 | A * | 9/1998 | Kahr | H01H 47/325 361/153 |
| 2005/0141167 | A1* | 6/2005 | Manzone | F02D 41/266 361/160 |

FOREIGN PATENT DOCUMENTS

| | | | |
|---|---|---|---|
| EP | 1154538 | A1 | 11/2001 |
| WO | 9740509 | A1 | 10/1997 |

OTHER PUBLICATIONS

European Search Report, EP16160102, dated Sep. 30, 2016, ABB S.p.A., 4 pages.

* cited by examiner

COIL ACTUATOR FOR LV OR MV APPLICATIONS

The present invention relates to a coil actuator for low or medium voltage applications, which has improved features in terms of performances and construction.

For the purposes of the present application, the term "low voltage" (LV) relates to operating voltages lower than 1 kV AC and 1.5 kV DC whereas the term "medium voltage" (MV) relates to operating voltages higher than 1 kV AC and 1.5 kV DC up to some tens of kV, e.g. up to 72 kV AC and 100 kV DC.

As is widely known, coil actuators are frequently used in MV and LV installations for a wide variety of purposes.

A typical use of coil actuators relates to the selective release or lock of mechanical parts in a spring-actuated switching apparatus.

Other typical uses may relate to the implementation of electrically commanded locking or tripping functionalities in mechanical kinematic chains or actuators.

Coil actuators normally comprise an electronics receiving an input voltage and driving, depending on said input voltage, an electromagnet, which includes one or more actuating coils operatively associated with a movable plunger in such a way that this latter can be magnetically actuated by a magnetic field generated by drive currents flowing along said actuating coils.

A drawback of conventional coil actuators consists in that the electromagnet is subject to remarkable thermal stresses when it receives multiple subsequent launch pulses of drive current to magnetically actuate the movable plunger.

The experience has shown that said thermal stresses may often lead to damages that make it necessary the substitution of the coil actuator with consequent increase of the maintenance and operating costs of the switching apparatus or switchgear in which the coil actuator in installed.

It is an object of the present invention to provide a coil actuator for LV or MV applications that allows solving or mitigating the above mentioned problems.

More in particular, it is an object of the present invention to provide a coil actuator having high levels of reliability for the intended applications.

As a further object, the present invention is aimed at providing a coil actuator having high levels of flexibility in operation.

Still another object of the present invention is to provide a coil actuator, which can be easily manufactured and at competitive costs.

In order to fulfill these aim and objects, the present invention provides a coil actuator, according to the following claim 1 and the related dependent claims.

The coil actuator, according to the invention, comprises an electromagnet operatively associated with a movable plunger in such a way that said movable plunger can be actuated by a magnetic field generated by said electromagnet.

The coil actuator, according to the invention, comprises also a power & control unit electrically connected with said electromagnet to feed this latter and control the operation thereof.

More particularly, said power & control unit is adapted to provide an adjustable drive current to said electromagnet to energize this latter according to the needs.

The coil actuator, according to the invention, further comprises first and second input terminals electrically connected with said power & control unit.

During the operation of the coil actuator, an input voltage, which may be provided by an external device (e.g. a relay), is applied between said first and second terminals.

The mentioned power & control unit is adapted to provide launch pulses of drive current to said electromagnet, which have a predetermined launch level and a launch time, in response to transitions of said input voltage from values lower than a first threshold voltage to values higher than said first threshold voltage.

An important aspect of the coil actuator, according to the invention, relates to the fact that that said power & control unit is adapted to provide subsequent launch pulses of drive current to said electromagnet, which are separated in time by at least a predetermined time interval.

The mentioned power & control unit is configured in such a way that, after having provided a first launch pulse of drive current to said electromagnet in response to a first transition of said input voltage from a value lower than said first threshold voltage to a value higher than said first threshold voltage, it waits for at least a predetermined time before providing a subsequent launch pulses of drive current to said electromagnet.

In practice, after having provided a first launch pulse of drive current to said electromagnet in response to a first transition of said input voltage from a value lower than said first threshold voltage to a value higher than said first threshold voltage, the mentioned power & control unit is disabled to provide subsequent launch pulses of drive current to said electromagnet for at least said predetermined time interval.

Preferably, the mentioned power & control unit is configured in such a way that, after having provided a launch pulse of drive current in response to a transition of said input voltage from a value lower than said first threshold voltage to a value higher than said first threshold voltage, it reduces said drive current to a predetermined hold level lower than said launch level and maintains said drive current at said hold level until said input voltage remains higher than a second threshold voltage, which is lower or equal than said first threshold voltage. Preferably, the mentioned power & control unit is configured in such a way that it interrupts a drive current flowing to said electromagnet in response to a transition of said input voltage from a value higher than a second threshold voltage, which is lower or equal than said first threshold voltage, to a value lower than said second threshold voltage.

In a further aspect, the present invention relates to a LV or MV switching apparatus or switchgear according to the following claim 11.

Figure 2:
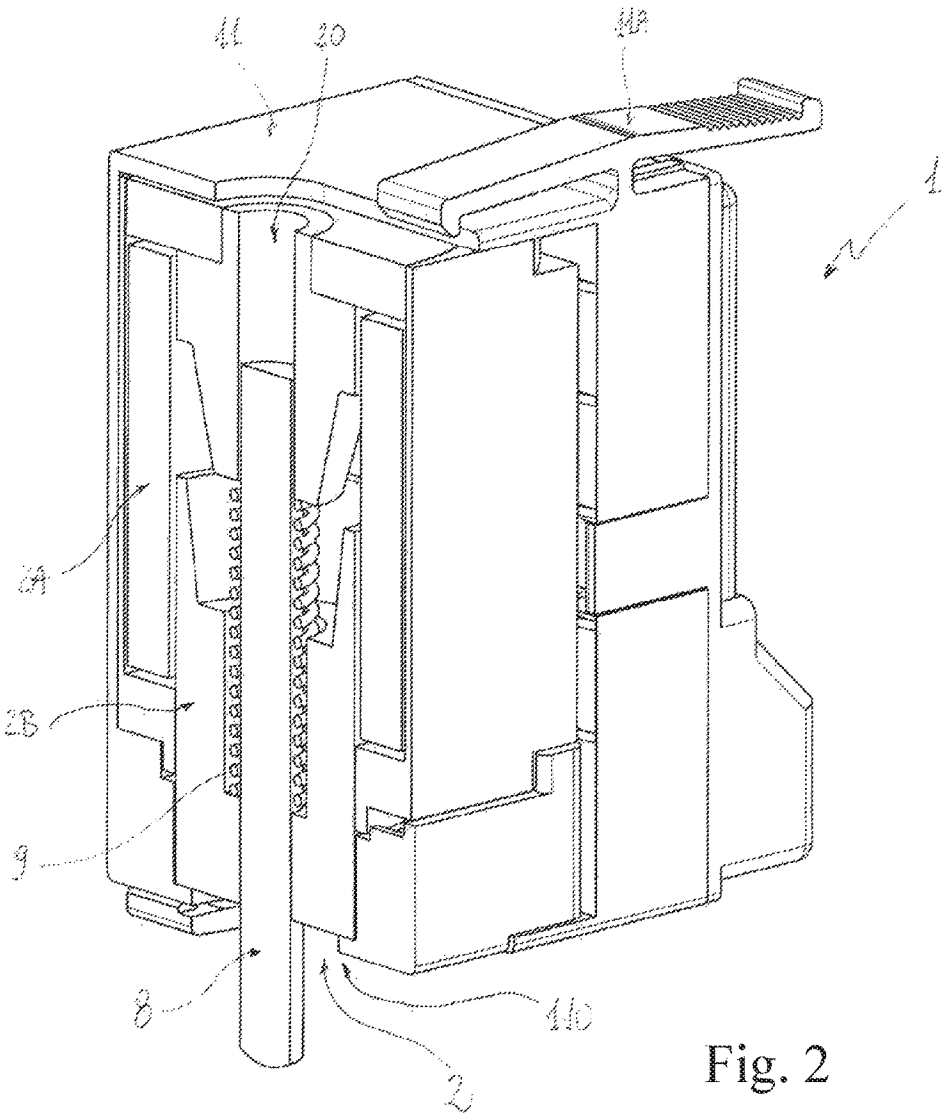
Figure 3:
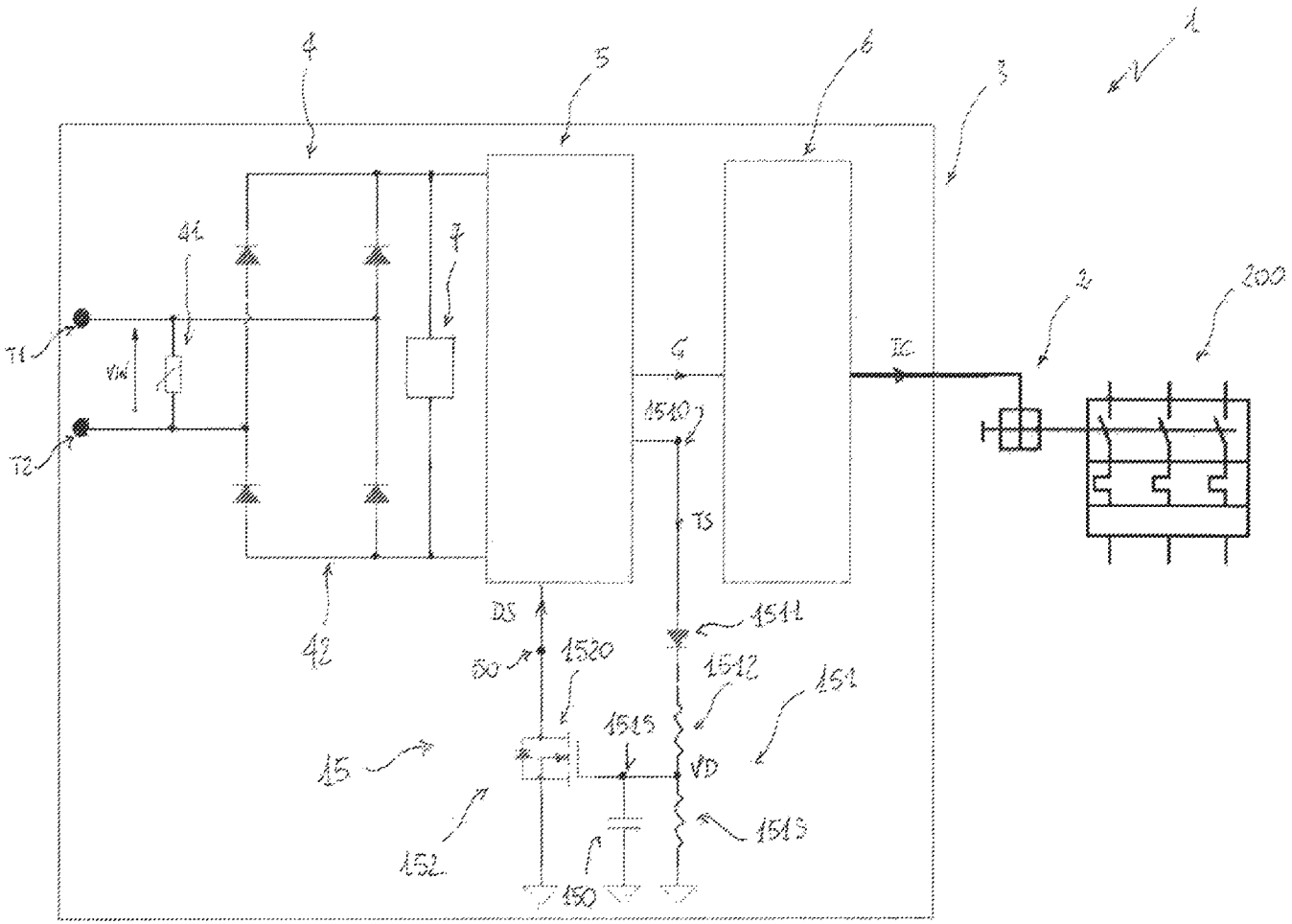
Figure 9:
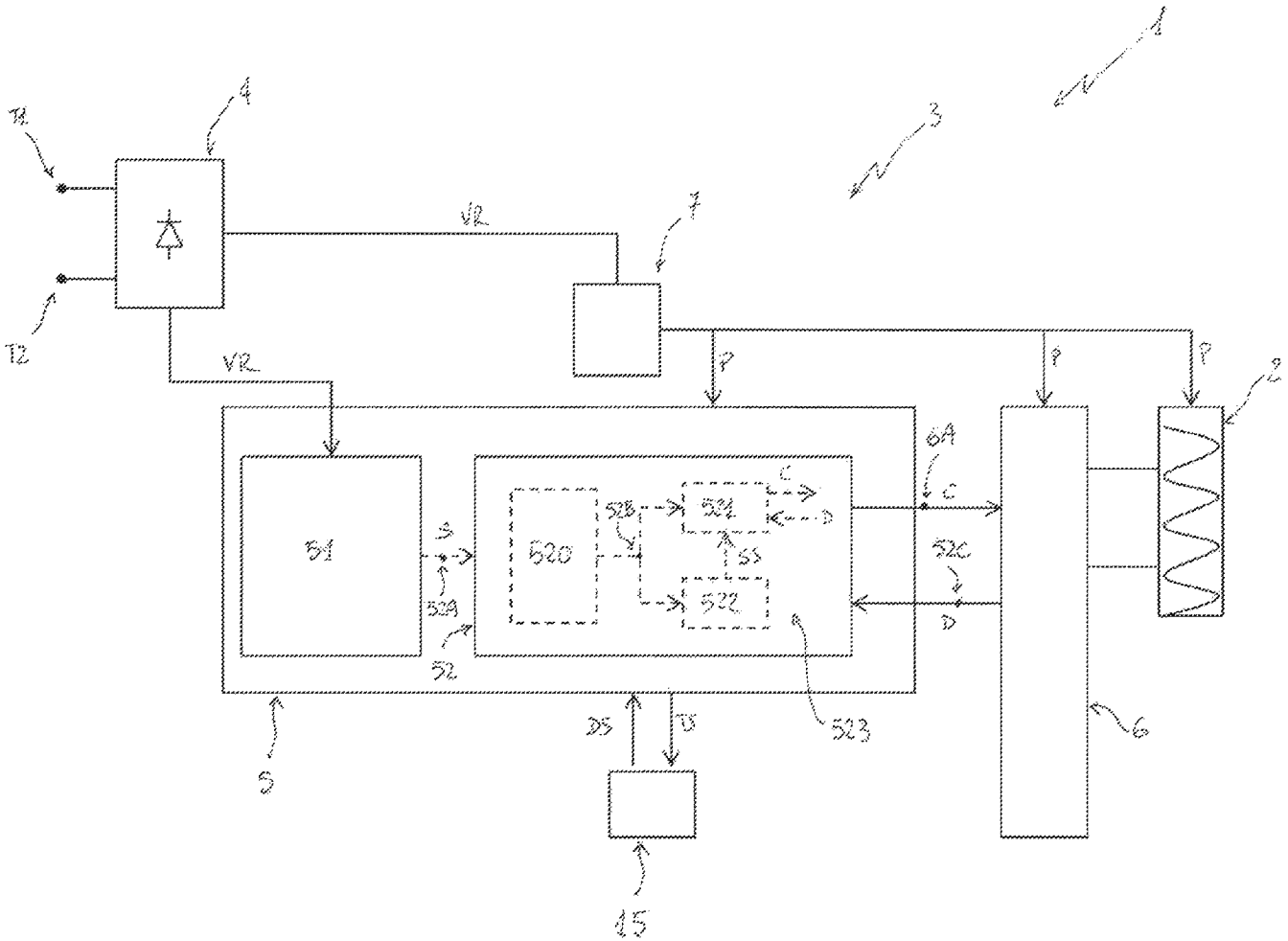
Figure 10:
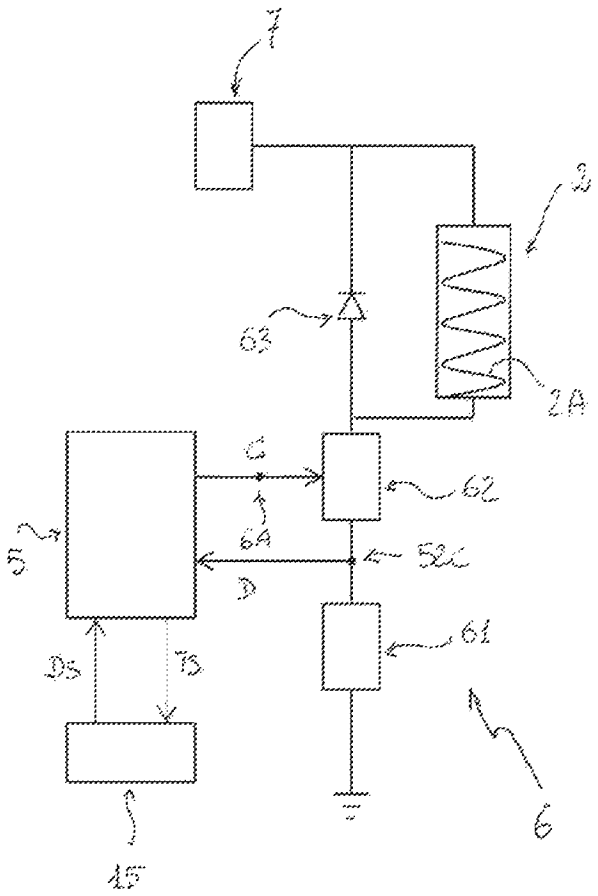
Figure 11:
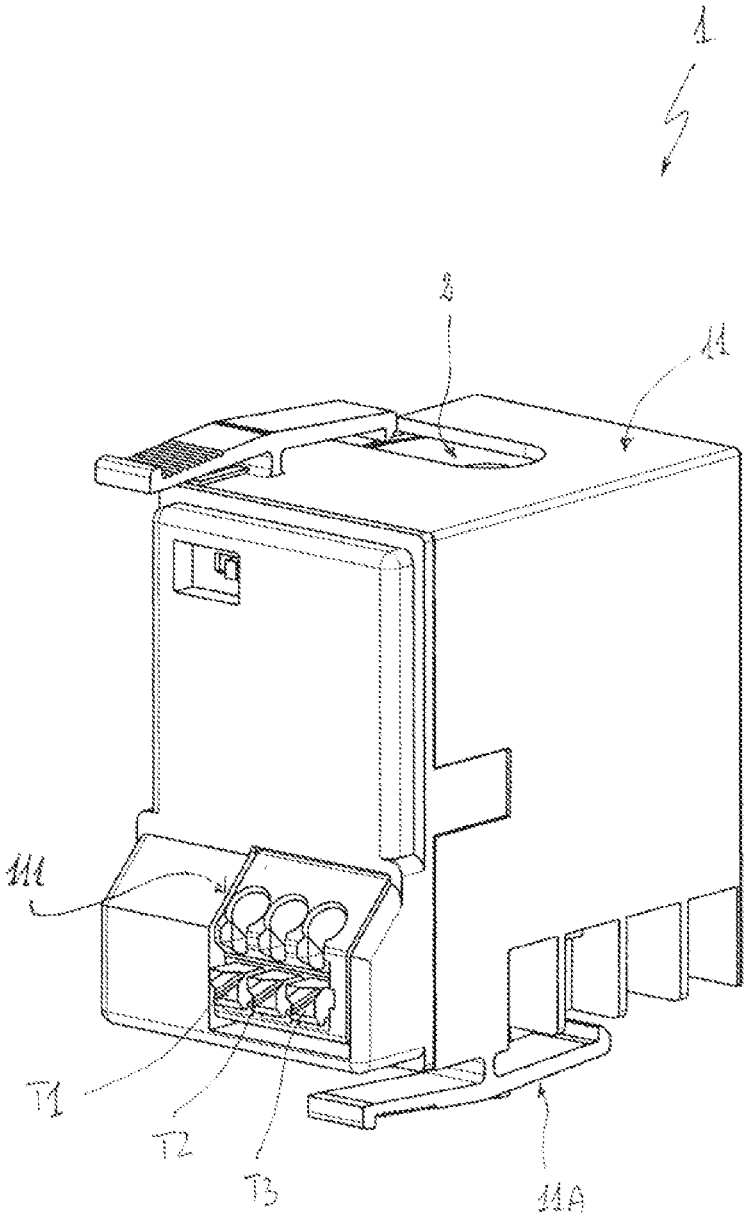

Further characteristics and advantages of the present invention will emerge more clearly from the description given below, referring to the attached figures, which are given as a non-limiting example, wherein:

FIGS. 1-3 show schematic views of an embodiment of the coil actuator, according to the invention;

FIGS. 4-8 schematically show the operation of the of the coil actuator, according to the invention;

FIGS. 9-10 show schematic views of a power & control unit on board the coil actuator of FIGS. 1-3;

FIG. 11 schematically shows a further embodiment of the coil actuator, according to the invention.

In the following detailed description of the invention, identical components are generally indicated by same reference numerals, regardless of whether they are shown in different embodiments. In order to clearly and concisely disclose the invention, the drawings may not necessarily be to scale and certain features of the invention may be shown in a schematic form.

With reference to the above-mentioned figures, the present invention concerns a coil actuator 1 for LV or MV applications such as, for example, LV or MV switching apparatuses (e.g. circuit breakers, disconnectors, contactors, and the like) or, more generally, LV or MV switchgears.

The coil actuator 1 comprises an outer casing 11 defining an internal volume and preferably made of an electrically insulating material (e.g. thermosetting resins).

Preferably, the outer casing 11 is provided with external flexible connection wings 11A adapted to allow the installation of the coil actuator on a supporting structure (not shown), e.g. through suitable snap-fit connections.

Preferably, the outer casing 11 is provided with a first opening 111 (FIG. 1), at which input terminals T1, T2 (or possibly T3) of the coil actuator 1 may be accessed.

The coil actuator 1 comprises an electromagnet 2 stably accommodated in the internal volume defined by the outer casing 11.

Preferably, the electromagnet 2 comprises at least an actuation coil 2A advantageously arranged according to a solenoid construction.

The actuation coil 2A is intended to be powered by an adjustable drive current IC to generate a magnetic field having a desired direction and intensity.

Preferably, the coil actuator 1 is of the single-coil type. In this case, the electromagnet 2 comprises a single actuation coil 2A.

Preferably, the electromagnet 2 comprises one or more portions 2B of magnetic material to properly direct the lines of the magnetic flux generated by the drive current IC energizing the electromagnet 2.

Preferably, the electromagnet 2 comprises an internal cavity 20 (e.g. having a cylindrical shape) surrounded by the actuation coil 2A and the portions 2B of magnetic material of the coil electromagnet 2.

The coil actuator 1 comprises a movable plunger 8 operatively associated to the electromagnet 2 such that it can be actuated by a magnetic field generated by a drive current IC flowing along the actuation coil 2A.

Preferably, the plunger 8 is accommodated in the internal cavity 20 of the electromagnet 2, through which it can move.

In general, the plunger 8 is linearly movable between a non-excited position, which is taken when no drive currents IC are provided to the actuation coil 2A, and an excited position, which is taken when a drive current IC is provided to the actuation coil 2A.

Preferably, the coil actuator 1 comprises an elastic element 9 (e.g. a spring) operatively associated with the plunger 8.

Preferably, the elastic element 9 is operatively coupled between a fixed anchoring point and the plunger 8 in such a way to exert a biasing force on this latter. Said biasing force may be advantageously used to actuate the plunger 8 when a drive current IC powering the actuation coil 2A is interrupted.

Preferably, the outer casing 11 is provided with a second opening 110 (FIG. 2) that allows the plunger 8 to protrude from the casing 11 and interface with a mechanism 200 of a switching apparatus or switchgear, with which the coil actuator 1 is intended to interact.

As an example, the mechanism 200 may be the primary command chain of a LV circuit breaker.

The coil actuator 1 comprises a power & control unit 3 electrically connected with the electromagnet 2, in particular with the actuation coil 2A of this latter.

Preferably, the power & control unit 3 is constituted by one or more electronic boards accommodated in the internal volume defined by the outer casing 11 and comprising analog and/or digital electronic circuits and/or processing devices.

The power & control unit 3 is configured to feed with an adjustable drive current IC the electromagnet 2 in order to control the operation (energization) of this latter and properly actuate the movable plunger 8.

Preferably, in order to move the plunger 8 from the non-excited position to the excited position, the power & control unit 3 provides a drive current IC to the electromagnet 2 (in particular to the actuation coil 2A) so that the plunger 8 is actuated by the force of the magnetic field generated by said drive current, against the biasing force exerted by the elastic element 9.

Preferably, in order to move the plunger 8 from the excited position to the non-excited position, the power & control unit 3 interrupts a drive current IC flowing to the actuation coil 2A so that the plunger 8 is actuated by the biasing force exerted by the elastic element 9, as no magnetic fields are generated by the electromagnet 2.

The coil actuator 1 comprises first and second input terminals T1, T2 electrically connected with the power & control unit 3.

During the operation of the coil actuator 1, an input voltage VIN is applied between the input terminals T1, T2 and is thus provided to the power & control unit 3.

The voltage VIN is provided to the coil actuator 1 by an external device (not shown) electrically connectable therewith, e.g. a relay or another protection device.

According to the invention, the power & control unit 3 is adapted to feed and control the electromagnet 2 depending on the input voltage VIN applied at the input terminals T1, T2. More particularly, the power & control unit 3 is adapted to feed the electromagnet 2 in such a way that the plunger 8 is magnetically actuated from the non-excited position to the excited position in response to transitions of the input voltage VIN from values lower than a first threshold voltage VTH1 to values higher than said first threshold voltage.

To this aim, the power & control unit 3 is adapted to provide launch pulses of drive current IC to the electromagnet 2, which have a predetermined launch level IL and a launch time TL, in response to transitions of the input voltage VIN from values lower than the first threshold voltage VTH1 to values higher than said first threshold voltage.

According to a preferred embodiment of the invention, which is shown in the cited figures, the power & control unit 3 is adapted to drive the electromagnet 2 in such a way that the coil actuator 1 operates as an UVR (Under Voltage Release) coil actuator.

In this case, as shown in FIGS. 4-8, the power & control unit 3 operates as follows.

Let the input voltage VIN show a transition from a value lower than the first threshold voltage VTH1 to a value higher than said first threshold voltage at the instant t1.

In response to said transition of the input voltage VIN, the power & control unit 3 provides a launch pulse of drive current IC to the electromagnet 2, which has a predetermined launch level IL and a launch time TL.

In this way, a quick and high energization of the electromagnet 2 to magnetically actuate the plunger 8 is obtained.

After having provided said launch pulse, at the instant t1+TL, the power & control unit 3 reduces the drive current IC to a predetermined hold level IH lower (e.g. even 10 times lower) than the launch level IL and maintains the drive current IC at the hold level IH until the input voltage VIN remains higher than a second threshold voltage VTH2, which is lower or equal than the first threshold voltage VTH1.

From the above, it is evident how, when the input voltage VIN becomes higher than the threshold voltage VTH1, the power & control unit 3 drives the electromagnet 2 in such a way that the plunger 8 performs a "launch and hold" movement (in opposition to the biasing force exerted by the elastic element 9), i.e. the plunger 8 is moved from the non-excited position to the excited position and is maintained in this latter position until the input voltage VIN remains higher than the threshold voltage VTH2.

Referring again to FIGS. 4-8, at the instant t2, the input voltage VIN is now supposed to show a transition from a value higher than the second threshold voltage VTH2 to a value lower than said second threshold voltage.

In response to said transition of the input voltage VIN, the power & control unit interrupts the drive current IC flowing to the electromagnet 2.

In this way, the de-energization of the electromagnet 2 is obtained and no magnetic fields are generated anymore.

The plunger 8 performs a "release" movement upon an actuation force exerted by the elastic element 9, i.e. it is moved from the excited position to the non-excited position and it stably remains in this latter position until the input voltage VIN remains lower than the threshold voltage VTH1.

Figure 4:
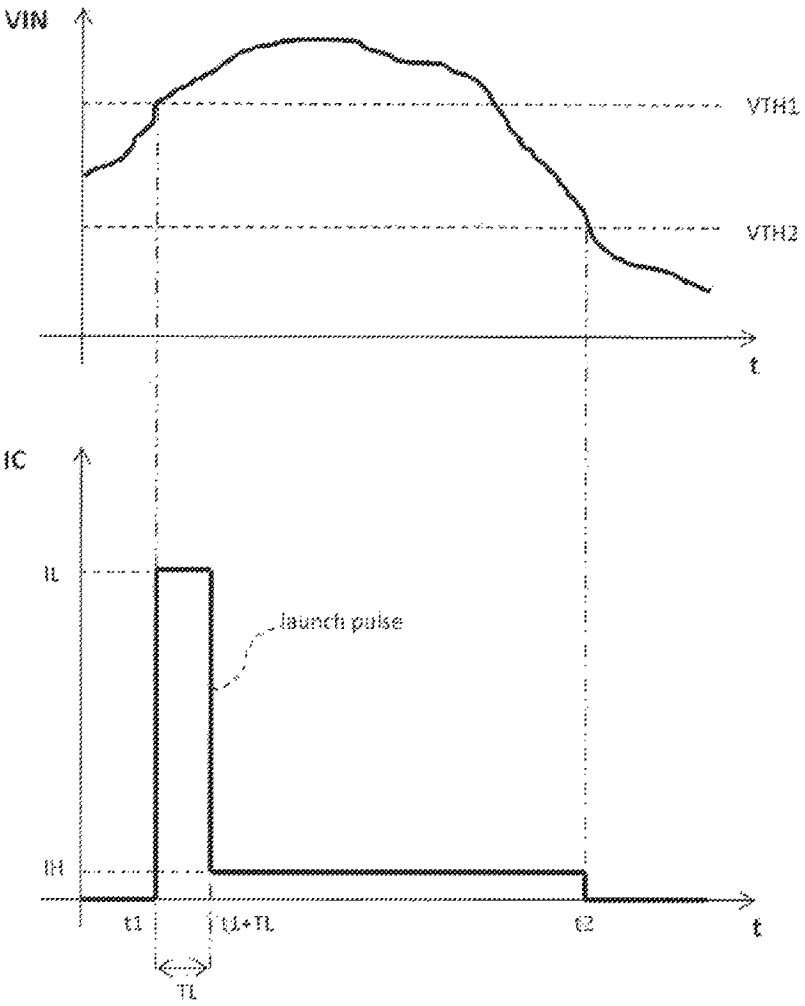
Figure 5:
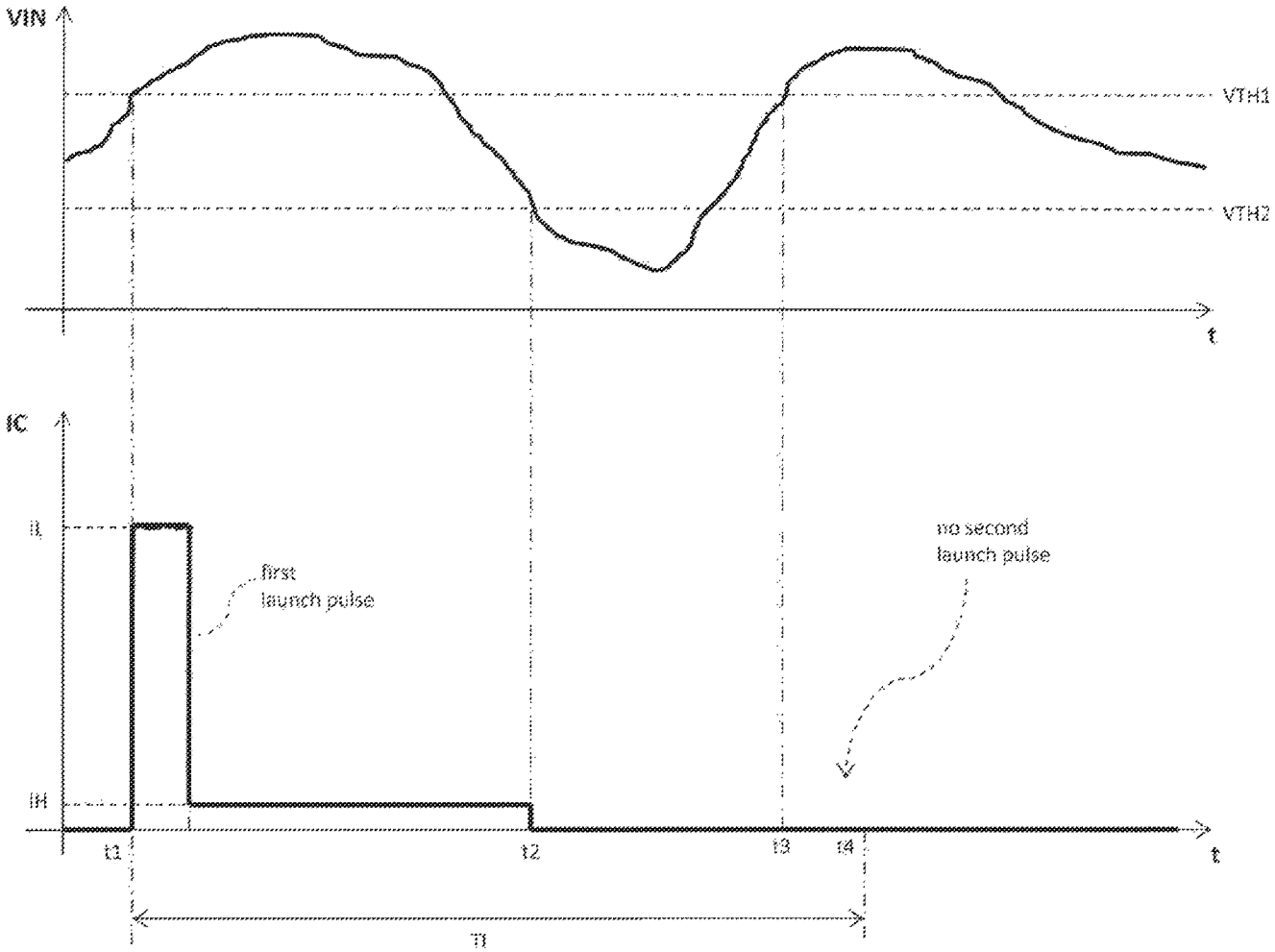
Figure 6:
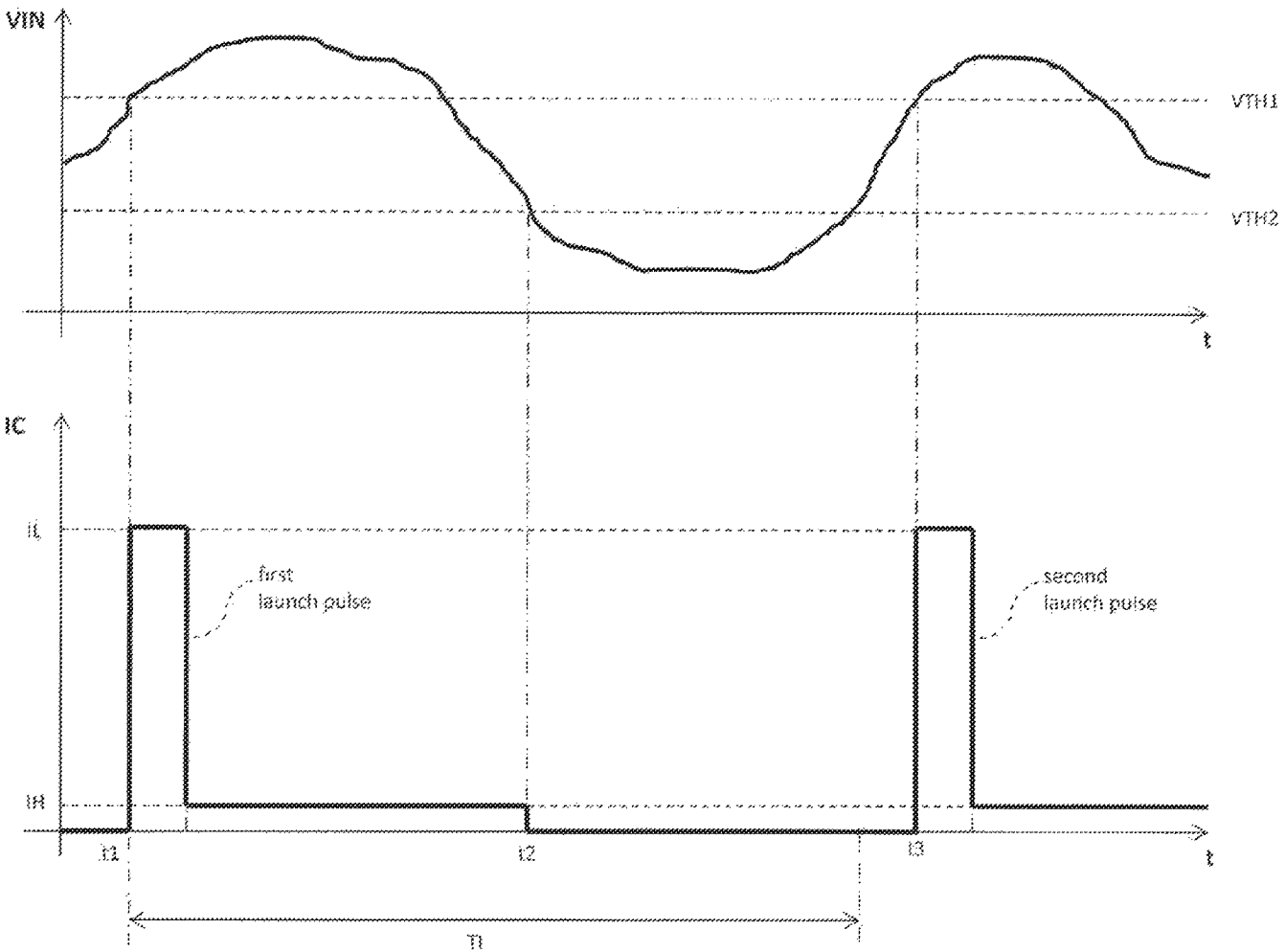

According to some embodiments of the invention, the second threshold voltage VTH2 is lower than the first threshold voltage VTH1. The behavior of the power & control unit 3, in this case, is schematically shown in FIGS. 4-6.

Figure 7:
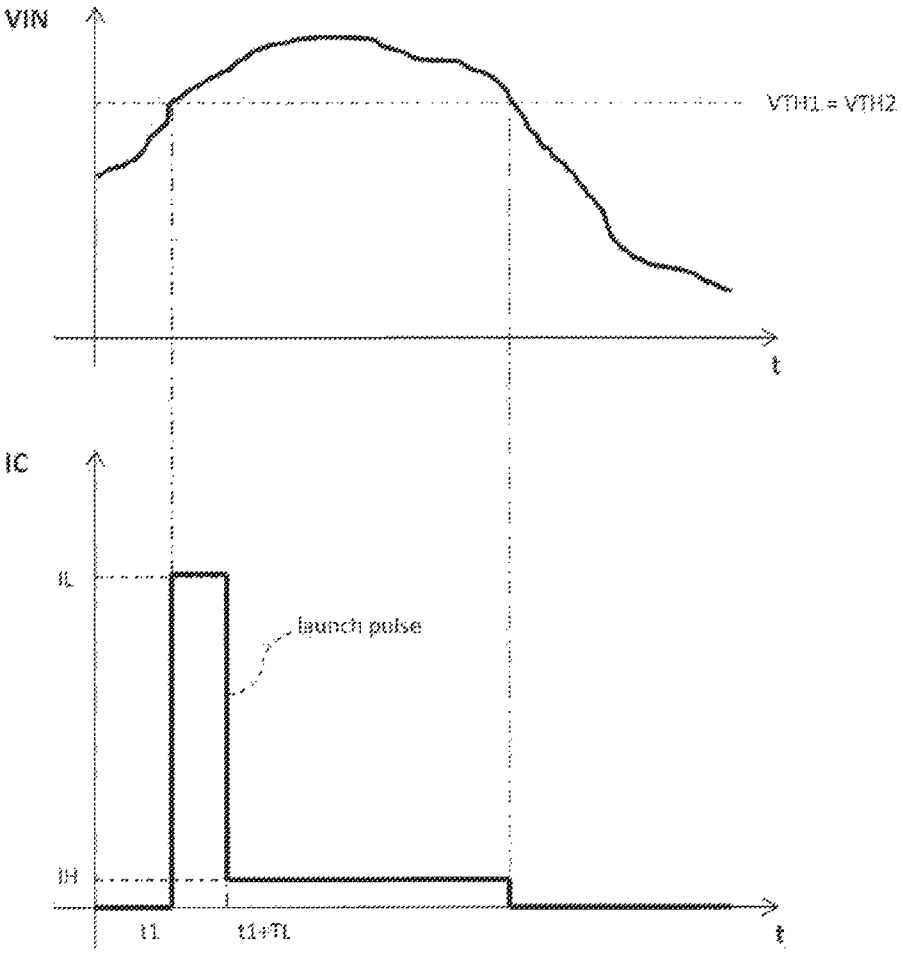
Figure 8:
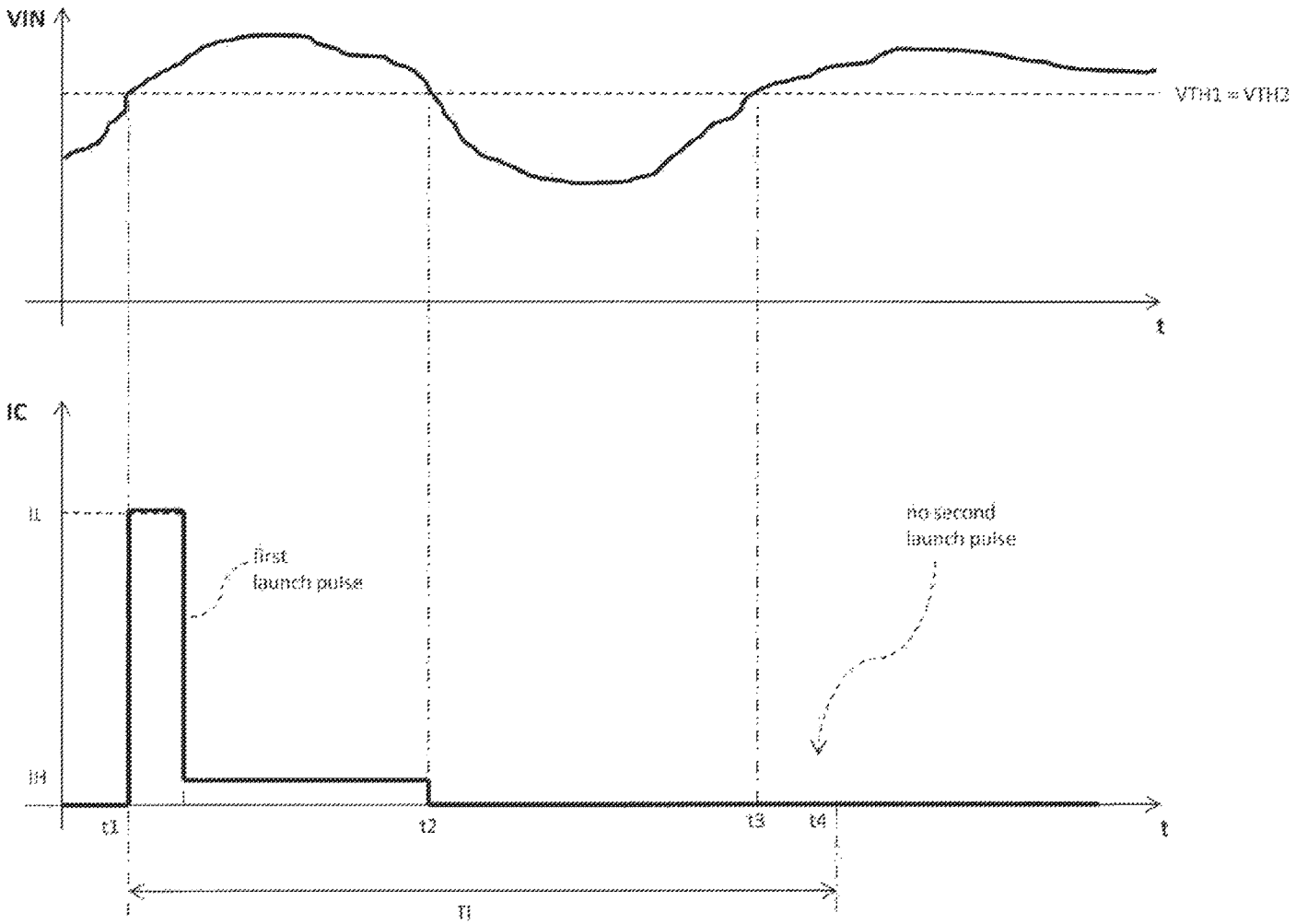

According to other embodiments of the invention, the first and second threshold voltages coincide. The behavior of the power & control unit 3, in this case, is schematically shown in FIGS. 7-8.

As it is possible to notice, the behavior of the power & control unit 3 is similar for both the mentioned cases.

According to alternative embodiments of the invention (not shown), the power & control unit is adapted to drive the electromagnet 2 in such a way the coil actuator 1 operates differently from the above, e.g. as a PSSOR (Permanent Supply Shunt Opening Release) device.

In this cases, the power & control unit 3 still drives the electromagnet 2 depending on the input voltage VIN applied at the input terminals T1, T2 but it implements a different way of controlling the movements of the plunger 8 with respect to the UVR control logic described above.

However, even according to these embodiments, the power & control unit 3 still provides launch pulses of drive current IC to the electromagnet 2, which have a predetermined launch level IL and a launch time TL, in response to transitions of the input voltage VIN from values lower than a given first threshold voltage VTH1 to values higher than said first threshold voltage.

An important aspect of the present invention relates to the behavior of the power & control unit 3 in response to subsequent transitions of the input voltage VIN from values lower than the first threshold voltage VTH1 to values higher than said first threshold voltage.

According to the invention, the power & control unit 3 is configured in such a way that, after having provided a first launch pulse of drive current IC to the electromagnet 2 in response to a first transition of the input voltage VIN from a value lower than the first threshold voltage VTH1 to a value higher than said first threshold voltage, it waits for at least a predetermined time interval TI before providing subsequent launch pulses of drive current IC to the electromagnet 2.

In practice, after having provided a first launch pulse of drive current to said electromagnet in response to a first transition of said input voltage from a value lower than said first threshold voltage to a value higher than said first threshold voltage, the mentioned power & control unit do not provide subsequent launch pulses of drive current to said electromagnet for at least the predetermined time interval TI.

The power & control unit 3 is thus adapted to provide subsequent launch pulses of drive current IC to the electromagnet 2, which are separated in time by at least a predetermined time interval TI.

Some examples of the behavior of the power & control unit 3, when the input voltage VIN shows subsequent transitions from a value lower than the first threshold voltage VTH1 to a value higher than said first threshold voltage, are better explained in the following (FIGS. 5, 5A, 6, 8).

Let the input voltage VIN show a first transition from a value lower than the first threshold voltage VTH1 to a value higher than said first threshold voltage at the instant t1.

In response to said transition of the input voltage VIN, the power & control unit 3 provides a first launch pulse of drive current IC to the electromagnet 2, which has a predetermined launch level IL and a launch time TL.

Starting from the instant t1, the power & control unit 3 waits for at least the predetermined time interval TI before providing a second subsequent launch pulse of drive current IC to the electromagnet 2.

This occurs even in case the input voltage VIN shows a second subsequent transition from a value lower than the first threshold voltage VTH1 to a value higher than said first threshold voltage before the expiration of the time interval TI.

Let the input voltage VIN show a second transition from a value lower than the first threshold voltage VTH1 to a value higher than said first threshold voltage at the instant t3.

Figure 5A:
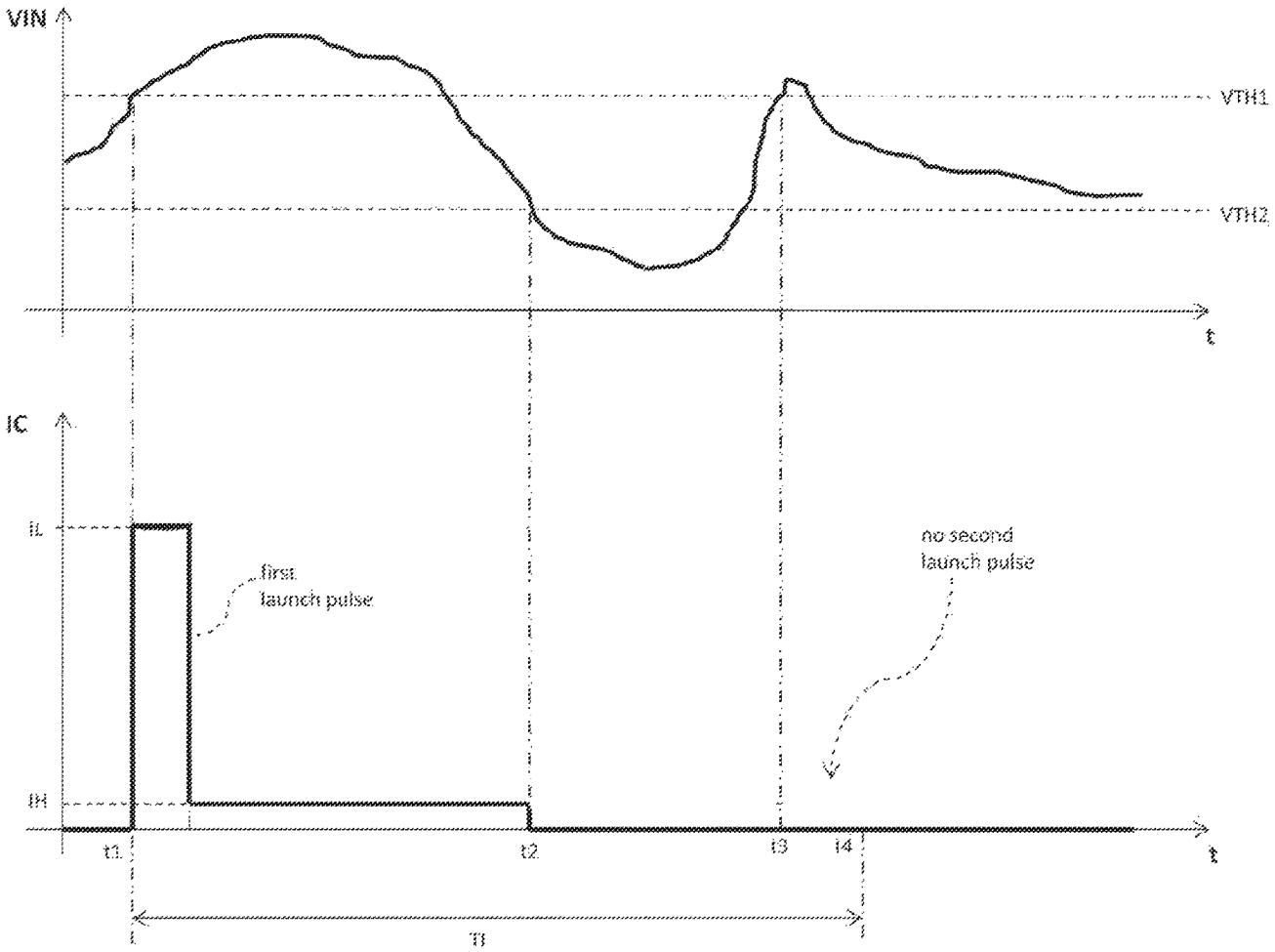

If the time difference (t3−t1) is shorter than the time interval T1 [i.e. the condition (t3−t1)<T1 occurs], at the instant t3, the power & control unit 3 does not provide a second subsequent launch pulse of drive current IC to the electromagnet 2 in response to said second subsequent transition of the input voltage VIN (FIGS. 5, 5A, 8).

The power & control unit 3 waits until the time interval TI (calculated from the instant t1) is elapsed before being again in condition of providing further launch pulses, if the applied voltage VIN requires to do so.

If at the instant t4=t1+TI the input voltage VIN is still higher than the first threshold voltage VTH1, at said instant t4, the power & control unit 3 provides no second subsequent launch pulses of drive current IC to the electromagnet 2 in response to the second subsequent transition of the input voltage VIN at the instant t3 (FIGS. 5, 8).

If at the instant t4=t1+TI the input voltage VIN has become lower than the first threshold voltage VTH1, the power & control unit 3 provides no second subsequent launch pulse of drive current IC to the electromagnet 2 in response to the second subsequent transition of the input voltage VIN at the instant t3 (FIG. 5A).

In practice, independently from the state of the voltage VIN at the instant t4=t3+TI, the power & control unit 3 merely ignores any subsequent transition of the input voltage VIN at the instant t3, if this latter occurred before the end of the time interval TI.

Figure 6A:
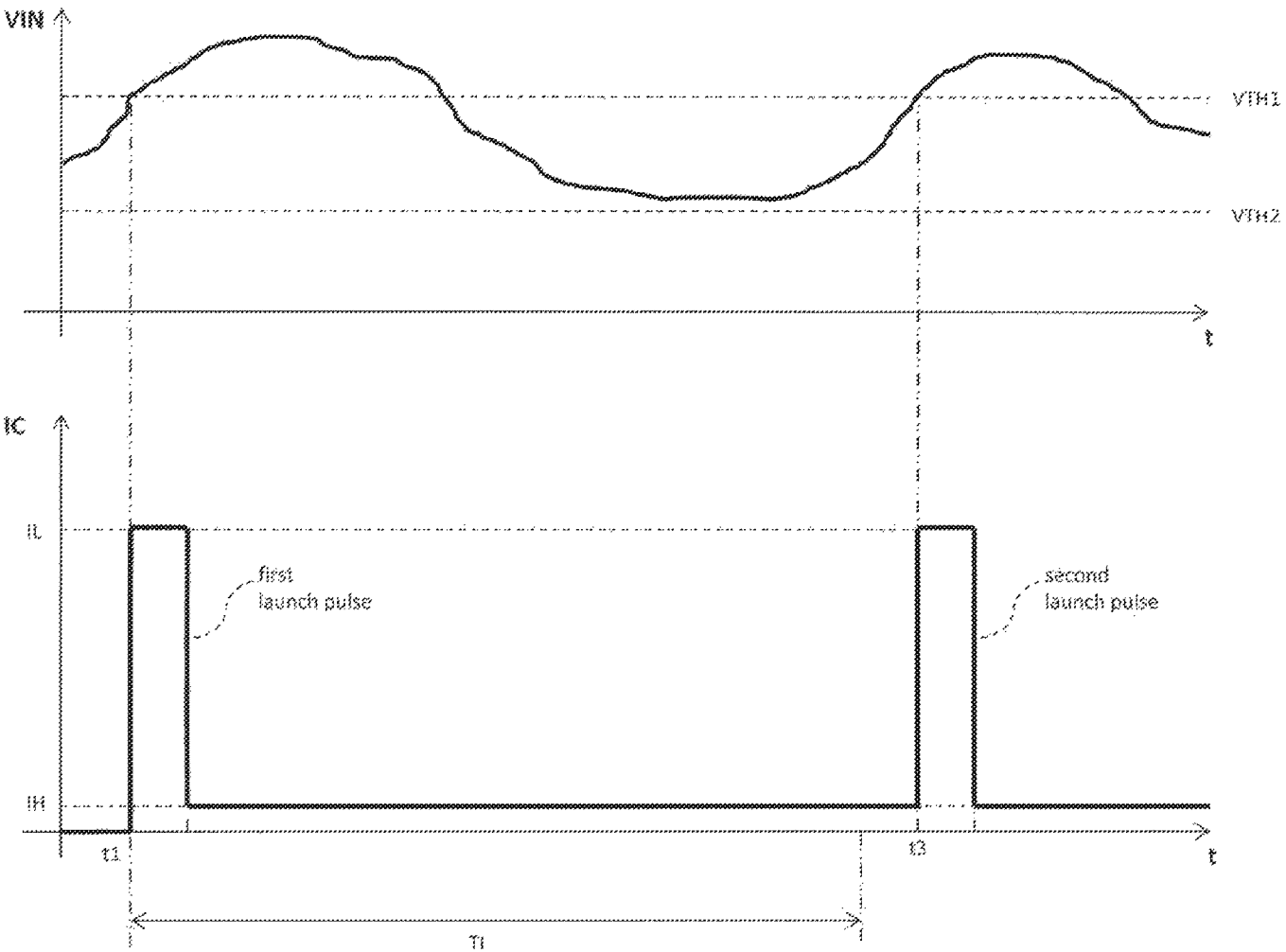

If the time difference (t3–t1) is longer or equal than the time interval T1 [i.e. the condition (t3–t1)>=T1 occurs], as the time interval TI has already elapsed (FIGS. 6, 6A), the power & control unit 3 immediately provides at the instant t3 a second subsequent launch pulse of drive current IC in response to the subsequent transition of the of the voltage VIN from a value lower than the first threshold voltage VTH1 to a value higher than said first threshold voltage.

Of course, the above illustrated FIGS. 5, 5A, 6, 6A, 8 show only some examples of behavior of the coil actuator 1 as a function of the applied voltage VIN. Further variants are possible depending on the behavior of the applied voltage VIN.

Again, it is evidenced that the described behavior of the power & control unit 3 is similar in the cases in which the threshold voltages VTH1, VTH2 are different (FIGS. 5, 5A, 6, 6A) or coincide (FIG. 8).

The above described solution provides relevant advantages when the applied input voltage VIN is instable for some reasons and the power & control unit 3 is forced to drive the electromagnet 2 in such a way that the plunger 8 performs multiple subsequent movements between the excited and non-excited positions due to fluctuations of the applied input voltage VIN.

As the power & control unit 3 ensures that subsequent launch pulses of drive current IC are separated at least by a predetermined time interval TI, over-heating phenomena of the electromagnet 2 (in particular of the actuating coil 2A) and of the power & control unit 3 are avoided or mitigated.

This brings to a considerable prolongation of the operating life of the coil actuator 1 with respect to the traditional solutions of the state of the art.

According to a preferred embodiment of the invention, which is shown in the cited figures, the power & control unit 3 comprises a cascade of electronic stages, namely an input stage 4, a control stage 5 and a drive stage 6.

Preferably, the input stage 4 is electrically connected with the input terminals T1, T2 and is adapted to receive the input voltage VIN between the terminals T1, T2 and provide a rectified voltage VR, the behavior of which depends of the input voltage VIN.

Preferably, the control stage 5 is operatively connected with the input stage 4.

Preferably, the control stage 5 is adapted to receive the rectified voltage VR from the input stage 4 and provide control signals C to control the operation of the electromagnet 2 depending on the rectified voltage VR.

Preferably, the drive stage 6 is operatively connected with the control stage 5 and the electromagnet 2, in particular with the actuation coil 2A of this latter.

Preferably, the drive stage 6 is adapted to receive the control signals C from the control stage 5 and adjust a drive current IC supplied to said electromagnet in response to said control signals.

Preferably, the power & control unit 3 comprises a feeding stage 7 operatively connected with the input stage 4, the control stage 5, the drive stage 6 and the coil electromagnet 2.

Preferably, the feeding stage 7 is adapted to receive the rectified voltage VR and provide the electric power P needed for the operation of the power & control unit 3 (namely the electronic stages 4, 5, 6) and the electromagnet 2.

Referring to the preferred embodiment shown in the cited figures, the input stage 4 preferably comprises a rectifying circuit 41 that may include a diode bridge suitably arranged according to configurations known to the skilled person (FIG. 1).

The input stage 4 may also comprise one or more filtering or protection circuits 42 suitably arranged according to configurations known to the skilled person.

Referring to FIG. 9, the control stage 5 preferably comprises a detection circuit 51 and a control circuit 52 electrically connected in cascade.

The detection circuit 51 is operatively connected with the input stage 4 and is adapted to receive the rectified voltage VR.

The detection circuit 51 is adapted to provide first detection signals S indicative of the received rectified voltage VR.

Preferably, the detection signals S are voltage signals, the behavior of which basically depends on the behavior of the applied voltage VIN.

Referring again to FIG. 9, the control circuit 52 preferably comprises a comparison section 520 operatively connected in cascade with the detection circuit 51.

The comparison section 520 is adapted to receive the detection signals S and provide comparison signals CS in response to said detection signals.

Preferably, the comparison section 520 comprises a comparator circuit arrangement operatively connected between an input node 52A and an intermediate node 52B of the control circuit 52 and suitably designed according to configurations known to the skilled person.

Preferably, the comparison signals CS provided by the comparison section 520 are voltage signals that may be at "high" or "low" logic levels depending on the input voltage signals S or OS.

Preferably, when it receives the detection signals S, the comparison section 520 compares these input signals with predefined comparison voltages, which advantageously depend on the threshold voltages VTH1, VTH2.

Preferably, such comparison voltages are provided by a dedicated circuit suitably arranged in the comparison section 520 according to configurations known to the skilled person.

Preferably, when it receives the detection signals S, the comparison section 520 provides comparison signals CS at high" or "low" logic levels depending on whether the detection signals S are lower or higher than said predefined comparison voltages.

Preferably, the control circuit 52 comprises a control section 523 operatively connected between the comparison section 520 (in particular the intermediate node 52B) and the drive stage 6 (in particular an input 6A of this latter).

The control section 523 is adapted to receive the comparison signals CS and provide the control signals C to the drive stage 6 in response to the comparison signals CS.

Preferably, the control section 523 is adapted to receive second detection signals D from the drive stage 6 at a second input node 52C of the control circuit 52.

Preferably, the detection signals D are indicative of the drive current IC feeding the electromagnet 2.

Advantageously, the control section 523 may comprise one or more controllers, e.g. microcontrollers or digital processing devices of different type, adapted to receive and provide a number of analog and/or digital inputs and comprising re-writable non-volatile memory areas that can be used to store executable software instructions or operating parameters.

Preferably, the control signals C and the detection signals are voltage signals.

Preferably, the control section 523 comprises a first controller 521 operatively connected between the comparison section 520 (in particular the intermediate node 52B) and the drive stage 6 (in particular the input node 6A).

The first controller 521 is adapted to receive the comparison signals CS and the detection signals D and provide the control signals C in response to said input signals.

In this way, the controller 521 is capable of controlling the drive stage 6 to properly energize or de-energize the electromagnet 2 according to the needs.

Preferably, the controller 521 is a PWM controller that is capable of controlling the drive stage 6 to perform a duty-cycle modulation of the drive current IC, which may be adjusted according to given setting parameters.

Preferably, the control section 523 comprises a second controller 522 operatively connected with the first controller 521.

The controller 522 is preferably adapted to provide setting signals SS for controlling the drive current IC, which are received and processed by the first controller 521 to provide the control signals C.

As an example, in order to provide a launch pulse of drive current IC, the controller 522 may initially provide setting signals SS indicative of the desired launch level IL and launch time TL to the controller 521.

Similarly, the controller 522 may provide setting signals SS indicative of a current reference value (e.g. the desired hold level IH) to be used by the controller 521 to perform a PWM adjustment of the drive current IC, when the electromagnet 2 has to be maintained energized. Preferably, the controller 522 is operatively connected with the comparison section 520 to receive and process the comparison signals CS and provide the setting signals SS depending on said comparison signals.

Referring to FIG. 10, the drive stage 6 preferably comprises a shunt resistor 61 and a first switch 62 electrically connected in series between the ground and the actuation coil 2A of the electromagnet 2, which is in turn electrically connected with the feeding stage 7 to receive electric power P.

In this way, a drive current IC, which can be properly adjusted by the switch 62, can flow through the actuation coil 2A, the switch 62 and the shunt resistor 61 during the operation of the coil actuator 1.

Preferably, the switch 62 is operatively connected with the control stage 5, in particular with the control circuit 53, to receive the control signals C and adjust the drive current IC depending on said control signals.

Preferably, the switch 62 is a MOSFET having the gate terminal electrically connected with the input node 6A, the drain terminal electrically connected in series with the actuation coil 2A and the source terminal electrically connected with the input node 52C.

However, the switch 62 may be also an IGBT, a BJT or another equivalent device.

Preferably, the shunt resistor 61 is electrically connected between the ground and the input node 52C is such a way to provide the detection signals D that are thus indicative of the drive current IC flowing towards the ground at the input node 52C.

Preferably, the drive stage 6 comprises a free-wheeling diode 63 electrically connected in series with the feeding stage 6 and the switch 62 and in parallel with the actuation coil 62. From the above, it is apparent how the drive stage 6 is capable of controlling the flow of a drive current IC through the actuation coil 2A.

The values of the drive current IC can be adjusted by the switch 62 depending on the operating status thereof, which in turn depends on the control signals C received from the control stage 5.

As an example, the switch 62 may receive control signals C to switch in interdiction state (OFF) in such a way to interrupt the flow of the drive current IC through the actuation coil 2A.

As a further example, the switch 62 may receive control signals C to operate in conduction state (ON) and modulate the flow of the drive current IC depending on said control signals, e.g. by implementing a PWM control of the drive current IC.

According to a preferred embodiment of the invention, the power & control unit 3 comprises a disabling stage 15 operatively connected with the said control stage 5.

The disabling stage 15 is adapted to prevent the control stage 5 from commanding a launch pulse of drive current IC to the electromagnet 2 for the predetermined time interval TI, starting from the instant (e.g. the instant t1 of FIG. 5) in which a preceding launch pulse of drive current IC is provided by the power & control unit 3 to the electromagnet 2.

In other words, the disabling circuit 15 is adapted to disable the control stage 5 from providing control signals C to provide a launch pulse of drive current IC to the electromagnet 2 for the predetermined time interval TI, starting from the instant in which a preceding launch pulse of drive current IC is commanded.

Preferably, the disabling circuit 15 comprises a temporization section 151 that includes charge storing means 150 (e.g. one or more capacitors) adapted to be charged by the control stage 5, when the power & control unit provides a launch pulse of drive current IC to the electromagnet 2.

Preferably, the temporization section 151 comprises an input node 1510, at which it is operatively connected with the control stage 5 to receive a charging signal TS from this latter, when a launch pulse of drive current IC is supplied to said electromagnet 2.

As an example, the charging signal TS may be a suitable voltage signal at "high" logic level. Preferably, the temporization section 151 comprises a protection diode 1511 and a resistive divider including the resistors 1512-1513, which are electrically connected in series between the input node 1510 and the ground.

Preferably, the temporization section 151 comprises one or more capacitors 150 electrically connected in parallel with the resistor 1513 between an output node 1515 (between the resistors 1512-1513) of the temporization section 151 and the ground.

Preferably, the disabling circuit 15 comprises a disabling section 152, which is electrically connected with the temporization section 151 in such a way to be driven by this latter. Preferably, the disabling section 152 is adapted to provide a disabling signal DS to the control stage to prevent this latter providing control signals C to supply a launch pulse of drive current IC.

As an example, the disabling signal DS may be a suitable voltage signal at "low" logic level. Preferably, the disabling section 152 comprises a second switch 1520 electrically connected between the ground, the output node 1515 of the temporization section 151 and an input node 50 of the control stage 5.

Preferably, the switch 1520 is a MOSFET having the gate terminal electrically connected with the node 1515, the drain terminal electrically connected with the node 50 and the source terminal electrically connected with the ground.

However, the switch 1520 may be also an IGBT, a BJT or another equivalent device.

The operation of the disabling circuit 15 is substantially the following.

When a launch pulse of drive current IC is supplied to said electromagnet 2 (e.g. at the instant t1 of FIG. 4), the control stage 5 provides a charging signal TS at the input node 1510 of the temporization section 151.

The protection diode 1511 switches in conduction state (ON state) and a driving voltage VD is present at the node 1515.

The driving voltage VD is at a "high" logic value to put the switch 1520 in conduction state (ON state) and progressively charge the capacitor 150.

As the switch 1520 passes in ON state, the voltage at its terminal connected with the input node 50 drops at values close to the ground voltage.

The control stage 5 thus receives a disabling voltage signal DS at the input node 50, thereby being prevented from commanding a further launch pulse of drive current IC (despite of the behavior of the input voltage VIN).

After having provided the launch pulse of drive current IC to the electromagnet 2 (e.g. at the instant t1+TL of FIG. 4), the control stage 5 stops providing the charging signal TS.

The capacitor 150 is progressively discharged as a discharging current flows from the capacitor 150 towards the ground, passing through the resistor 1513, given the fact that the protection diode 1511 switches in interdiction state (OFF state) and blocks the circulation of currents to the control stage 5.

The driving voltage VD at the node 1515 is still maintained at a "high" logic value for an additional time period TA, the duration of which depends on the time constant characterizing the discharging process of the capacitor 150.

During the additional time period TA, the switch 1520 is maintained in conduction state and the control stage 5 continues receiving the disabling signals DS at the input node 50.

At the end of the additional time period TA, the capacitor 150 is discharged and the driving voltage VD at the node 1515 drops to a voltage close to the ground voltage.

As a result, the switch 1520 switches in interdiction state and the control stage 5 stops receiving the disabling signal DS at the input node 50.

The control stage 5 is again enabled to provide control signals C to supply a further launch pulse of drive current IC, if the behavior of the input voltage VIN requires to do so.

From the above, it is evident how the disabling circuit 15 is capable of preventing the control stage 5 from commanding a launch pulse of drive current IC for the predetermined time interval TI≈TL+TA, starting from the instant t1 in which a preceding launch pulse of drive current IC is commanded.

Preferably, the disabling circuit 15 is operatively connected with the controller 152 of the control circuit 52 and is configured to interact with this latter to receive the charging signal TS and provide the disabling signal DS.

Preferably, the controller 152 is adapted to provide suitable setting signals SS to the PWM controller 151 in response to the disabling signal DS so that the PWM controller 151 is prevented from commanding of a further launch pulse of drive current IC.

According to a further alternative embodiment of the invention, the coil actuator 1 comprises a third input terminal T3 electrically connected with the power & control unit 3.

The input terminal T3 is adapted to take different operating conditions corresponding to different control conditions adopted by the power & control unit 3 to control the operation of the electromagnet 2.

More particularly, the input terminal T3 is adapted to be in a first operating condition or in a second operating position, which respectively correspond to normal control conditions or overriding control conditions adopted by the power & control unit 3 to control the operation of the electromagnet 2.

The operating conditions of the input terminal T3 basically depend on the electrical connectivity status of this latter.

Preferably, when it is in the first operating condition A, the input terminal T3 is electrically floating in such a way that no currents flow through it, whereas, when it is in the second operating condition B, the input terminal T3 is electrically connected to an electrical circuit, e.g. ground, a circuit operatively connected with the coil actuator or a circuit comprised in the coil actuator, and the like.

Preferably, when it is in the second operating condition B, the input terminal T3 is electrically coupled with one of the input terminals T1, T2.

Preferably, the reversible transition of the input terminal T3 between the operating conditions A, B is controlled by a control device external to the coil actuator 1.

Preferably, said control device is operatively coupled with the terminal T3 in such a way to be able to electrically couple or decouple the terminal T3, in a reversible way, with or from one of the input terminals T1, T2. As an example, said control device may be constituted by a switch operable by a relay, a user or any actuating device.

By way of example, the input terminal T3 may be electrically coupled with the input terminals T2, when it is in the second operating condition B.

It is however intended that, according to the needs, the input terminal T3 may be electrically coupled with the input terminals T1, when it is in the second operating condition B.

In AC applications (i.e. when the input voltage VIN is an AC voltage), the input terminal T3 may be electrically coupled with anyone of the input terminals T1-T2, when it is in the second operating condition B.

In DC applications (i.e. when the input voltage VIN is a DC voltage), the input terminal T3 is preferably coupled with the terminal T1 or T2 intended to be put at positive voltage, when it is in the second operating condition B.

However, in certain DC applications, the input terminal T3 may be coupled with the input terminal T1 or T2 intended to be grounded or put at negative voltage, when it is in the second operating condition B.

According to this embodiment of the invention, the power & control until 3 is adapted to control the electromagnet 2, in particular the energization of this latter by a drive current IC flowing through the actuation coil 2A, according to the mentioned normal control conditions or overriding control conditions depending on the operating conditions of the third input terminal T3.

Preferably, the power & control until 3 controls the electromagnet 2 according to the mentioned normal control conditions, when it controls the energization of said electromagnet depending on the input voltage VIN applied at the input terminals T1, T2.

The power & control unit 3 is therefore adapted to provide an adjustable drive current IC to the electromagnet 2 depending on the input voltage VIN applied at the input terminals T1-T2, when the input terminal T3 is in the first operating condition.

On the other hand, the power & control until 3 controls the electromagnet 2 according to the mentioned overriding control conditions, when it controls the energization of said electromagnet independently from the input voltage VIN applied at the input terminals T1, T2.

The power & control unit 3 is therefore adapted to operate independently from the input voltage VIN applied at the input terminals T1, T2, when the input terminal T3 is in the second operating condition.

Preferably, when the input terminal T3 is in said second operating condition, the power & control unit 3 does not provide any drive current to the electromagnet 2 independently from the input voltage VIN applied at the input terminals T1, T2.

In practice, when the input terminal T3 is the second operating condition, the electromagnet 2 is forced to be or remain de-energized and the plunger 8 is forced to move to or remain in the non-excited position, independently from the input voltage VIN.

The operation of the coil actuator 1, when the input terminal T3 reversibly switches between the mentioned first and second operating conditions is now briefly described.

When the input terminal T3 switches from the first operating condition to the second operating condition at a given instant, the power & control unit 3 stops controlling the electromagnet 2 in accordance with the mentioned normal control conditions and starts controlling the electromagnet 2 in accordance with the mentioned overriding control conditions.

Let the power & control unit 3 implement an UVR control logic when controlling the electromagnet 2 in accordance to the mentioned normal control conditions. We have that:

- if the power & control unit 3 is providing a drive current IC (e.g. at a launch level I1 or at a hold level IH) to the electromagnet 2 at said given instant, the electromagnet 2 is de-energized and the plunger 8 is forced to move from the excited position to the non-excited position ("release" movement) and remains in this latter position until the input terminal T3 remains the second operating condition; or
- if the power & control unit 3 is not providing a drive current to the electromagnet 2 at said given instant (e.g. because the input voltage VIN is lower than the second threshold voltage VTH2), the electromagnet 2 is maintained de-energized and the plunger 8 remains in the non-excited position until the input terminal T3 remains the second operating condition.

When the input terminal T3 switches from the second operating condition to the first operating condition at a given instant, the power & control unit 3 stops controlling the electromagnet 2 in accordance with the mentioned overriding control conditions and starts controlling the electromagnet 2 in accordance with the mentioned normal control conditions. Let the power & control unit 3 implement an UVR control logic when controlling the electromagnet 2 in accordance to the mentioned normal control conditions. We have that:

- if the input voltage VIN is higher than the threshold voltage VTH1 at said given instant, the electromagnet 2 is energized and the plunger 8 is forced to move from the non-excited position to the excited position and remains in this latter position until the voltage VIN remains higher than the threshold voltage VTH2 ("launch and hold" movement); or
- if the input voltage VIN is lower than the threshold voltage VTH1 at said given instant, the electromagnet 2 is maintained de-energized and the plunger 8 remains in the non-excited position until the voltage VIN remains lower than the threshold voltage VTH1.

Again, it is evidenced that the described behavior of the power & control unit 3 is similar in the cases in which the threshold voltages VTH1, VTH2 are different or coincide.

Thanks to the presence of the third terminal T3, the coil actuator 1 shows improved performances with respect to corresponding devices of the state of the art.

The operating status of the coil actuator 1 can be controlled independently from the values of the applied input voltage VIN, particularly when "release" movements of the movable plunger are needed.

The coil actuator 1 shows therefore different operation modes, which may be easily selected by properly switching the terminal T3.

Such a flexibility in operation makes the coil actuator 1 quite suitable for integration in LV or MV switchgears.

It has been shown in practice how the coil actuator 1, according to the present invention, fully achieves the intended aim and objects.

Due to the improved performances of the power & control unit 3, overheating phenomena of the electromagnet 2 are remarkably reduced.

The coil actuator 1 shows a higher level of reliability with respect to conventional device of the same type.

The coil actuator has a very compact structure, which may be industrially realized at competitive costs with respect to traditional devices of the state of the art.

The coil actuator, according to the invention, thus conceived may undergo numerous modifications and variants, all coming within the scope of the inventive concept. Moreover, all the component parts described herein may be substituted by other, technically equivalent elements. In practice, the component materials and dimensions of the device may be of any nature, according to needs.

The invention claimed is:

1. A coil actuator for low and medium voltage applications comprising:

- an electromagnet operatively associated with a movable plunger to actuate said movable plunger;
- a power & control unit electrically connected with said electromagnet to provide an adjustable driving current (IC) to said electromagnet;
- first and second input terminals (T1, T2) electrically connected with said power & control unit, wherein an input voltage (VIN) is applied between said first and second input terminals during the operation of said coil actuator;
- wherein said power & control unit is adapted to provide launch pulses of drive current (IC) to said electromagnet, which have a predetermined launch level (IL) for a predetermined launch time (TL), in response to transitions of said input voltage (VIN) from values lower than a first threshold voltage (VTH1) to values higher than said first threshold voltage;
- wherein said power & control unit is configured such that, after having provided a first launch pulse of drive current (IC) to said electromagnet in response to a first transition of said input voltage (VIN) from a value lower than said first threshold voltage (VTH1) to a value higher than said first threshold voltage, said power & control unit waits for at least a predetermined time interval (TI) before providing subsequent launch pulses of drive current (IC) to said electromagnet.

2. The coil actuator according to claim 1, wherein said power & control unit is adapted to reduce said drive current (IC) to a predetermined hold level (IH) lower than said launch level (IL) and to maintain said drive current at said hold level (IH) until said input voltage (VIN) remains higher than a second threshold voltage (VTH2), which is lower or equal than said first threshold voltage, after having provided a launch pulse of drive current (IC) in response to a transition of said input voltage (VIN) from a value lower than said first threshold voltage (VTH1) to a value higher than said first threshold voltage.

3. The coil actuator according to claim 2, wherein said power & control unit is adapted to interrupt a drive current (IC) flowing to said electromagnet in response to a transition of said input voltage (VIN) from a value higher than a second threshold voltage (VTH2), which is lower or equal than said first threshold voltage (VTH1), to a value lower than said second threshold voltage.

4. The coil actuator according to claim 2, wherein said power & control unit comprises:

an input stage electrically connected with said first and second input terminals (T1, T2), wherein said input stage is adapted to receive said input voltage (VIN) and provide a rectified voltage (VR) obtained by rectifying said input voltage;

a control stage operatively connected with said input stage, wherein said control stage is adapted to receive said rectified voltage (VR) and provide control signals (C) to control the operation of said electromagnet;

a drive stage operatively connected with said control stage and said electromagnet, wherein said drive stage is adapted to receive said control signals (C) from said control stage and adjust a drive current (IC) to said electromagnet in response to said control signals.

5. The coil actuator according to claim 4, wherein said power & control unit comprises a disabling stage adapted to prevent said control stage from commanding a subsequent launch pulses of drive current (IC) to said electromagnet for said predetermined time interval (TI), starting from the instant in which a launch pulse of drive current (IC) is provided by said power & control unit to said electromagnet.

6. The coil actuator according to claim 1, wherein said power & control unit is adapted to interrupt a drive current (IC) flowing to said electromagnet in response to a transition of said input voltage (VIN) from a value higher than a second threshold voltage (VTH2), which is lower or equal than said first threshold voltage (VTH1), to a value lower than said second threshold voltage.

7. The coil actuator according to claim 6, wherein said power & control unit comprises:

an input stage electrically connected with said first and second input terminals (T1, T2), wherein said input stage is adapted to receive said input voltage (VIN) and provide a rectified voltage (VR) obtained by rectifying said input voltage;

a control stage operatively connected with said input stage, wherein said control stage is adapted to receive said rectified voltage (VR) and provide control signals (C) to control the operation of said electromagnet;

a drive stage operatively connected with said control stage and said electromagnet, wherein said drive stage is adapted to receive said control signals (C) from said control stage and adjust a drive current (IC) to said electromagnet in response to said control signals.

8. The coil actuator according to claim 7, wherein said power & control unit comprises a disabling stage adapted to prevent said control stage from commanding a subsequent launch pulses of drive current (IC) to said electromagnet for said predetermined time interval (TI), starting from the instant in which a launch pulse of drive current (IC) is provided by said power & control unit to said electromagnet.

9. The coil actuator according to claim 1, wherein said power & control unit comprises:

an input stage electrically connected with said first and second input terminals (T1, T2), wherein said input stage is adapted to receive said input voltage (VIN) and provide a rectified voltage (VR) obtained by rectifying said input voltage;

a control stage operatively connected with said input stage, wherein said control stage is adapted to receive said rectified voltage (VR) and provide control signals (C) to control the operation of said electromagnet;

a drive stage operatively connected with said control stage and said electromagnet, wherein said drive stage is adapted to receive said control signals (C) from said control stage and adjust a drive current (IC) to said electromagnet in response to said control signals.

10. The coil actuator according to claim 9, wherein said power & control unit comprises a disabling stage adapted to prevent said control stage from commanding a subsequent launch pulses of drive current (IC) to said electromagnet for said predetermined time interval (TI), starting from the instant in which a launch pulse of drive current (IC) is provided by said power & control unit to said electromagnet.

11. The coil actuator according to claim 10, wherein said disabling stage comprises:

a temporization section including charge storing means adapted to be charged by said control stage, when said power & control unit provides a launch pulse of drive current (IC) to said electromagnet;

a disabling section adapted to prevent said control stage from commanding a launch pulse of drive current (IC), said disabling section being driven by said temporization section.

12. The coil actuator according to claim 1, wherein said power & control unit comprises a third input terminal (T3) electrically connected with said power & control unit, said third input terminal being adapted to be in a first operating condition, which corresponds to normal control conditions for the operation of said electromagnet, or in a second operating condition, which corresponds to overriding control conditions for the operation of said electromagnet, said power & control until being adapted to control the operation of said electromagnet according to said normal control conditions or said overriding control conditions depending on the operating condition of said third input terminal.

13. The coil actuator according to claim 12, wherein said power & control unit is adapted to control said electromagnet depending on the input voltage (VIN) applied between said first and second terminals (T1, T2), when said third input terminal (T3) is in said first operating condition.

14. The coil actuator according to claim 13, wherein said power & control unit is adapted to control said electromagnet independently from the input voltage (VIN) applied between said first and second input terminals (T1, T2), when said third input terminal (T3) is in said second operating condition.

15. The coil actuator according to claim 12, wherein said power & control unit is adapted to control said electromagnet independently from the input voltage (VIN) applied between said first and second input terminals (T1, T2), when said third input terminal (T3) is in said second operating condition.

16. The coil actuator according to claim 1, wherein said electromagnet comprises a single actuation coil.

17. A low and medium voltage switching apparatus or switchgear characterised in that it comprises a coil actuator, according to claim 1.

18. The coil actuator according to claim 1, wherein said electromagnet comprises a single actuation coil;

wherein said power & control unit comprises a third input terminal (T3) electrically connected with said power & control unit, said third input terminal being adapted to be in a first operating condition, which corresponds to normal control conditions for the operation of said electromagnet, or in a second operating condition, which corresponds to overriding control conditions for the operation of said electromagnet, said power & control until being adapted to control the operation of said electromagnet according to said normal control conditions or said overriding control conditions depending on the operating condition of said third input terminal;

wherein said power & control unit is adapted to reduce said drive current (IC) to a predetermined hold level (IH) lower than said launch level (IL) and to maintain said drive current at said hold level (IH) until said input voltage (VIN) remains higher than a second threshold voltage (VTH2), which is lower or equal than said first threshold voltage, after having provided a launch pulse of drive current (IC) in response to a transition of said input voltage (VIN) from a value lower than said first threshold voltage (VTH1) to a value higher than said first threshold voltage;

wherein said power & control unit is adapted to interrupt a drive current (IC) flowing to said electromagnet in response to a transition of said input voltage (VIN) from a value higher than a second threshold voltage (VTH2), which is lower or equal than said first threshold voltage (VTH1), to a value lower than said second threshold voltage;

wherein said power & control unit comprises: an input stage electrically connected with said first and second input terminals (T1, T2), wherein said input stage is adapted to receive said input voltage (VIN) and provide a rectified voltage (VR) obtained by rectifying said input voltage; a control stage operatively connected with said input stage, wherein said control stage is adapted to receive said rectified voltage (VR) and provide control signals (C) to control the operation of said electromagnet; a drive stage operatively connected with said control stage and said electromagnet, wherein said drive stage is adapted to receive said control signals (C) from said control stage and adjust a drive current (IC) to said electromagnet in response to said control signals;

wherein said power & control unit comprises a disabling stage adapted to prevent said control stage from commanding a subsequent launch pulses of drive current (IC) to said electromagnet for said predetermined time interval (TI), starting from the instant in which a launch pulse of drive current (IC) is provided by said power & control unit to said electromagnet; and wherein said disabling stage comprises: a temporization section including charge storing means adapted to be charged by said control stage, when said power & control unit provides a launch pulse of drive current (IC) to said electromagnet; and a disabling section adapted to prevent said control stage from commanding a launch pulse of drive current (IC), said disabling section being driven by said temporization section.

19. A low and medium voltage switching apparatus or switchgear characterised in that it comprises a coil actuator, according to claim 18.

20. The coil actuator according to claim 1 wherein said power & control unit is adapted to control said electromagnet independently from the input voltage (VIN) applied between said first and second input terminals (T1, T2), when said third input terminal (T3) is in said second operating condition;

wherein said power & control unit is adapted to control said electromagnet depending on the input voltage (VIN) applied between said first and second terminals (T1, T2), when said third input terminal (T3) is in said first operating condition; and wherein said power & control unit comprises a third input terminal (T3) electrically connected with said power & control unit, said third input terminal being adapted to be in a first operating condition, which corresponds to normal control conditions for the operation of said electromagnet, or in a second operating condition, which corresponds to overriding control conditions for the operation of said electromagnet, said power & control until being adapted to control the operation of said electromagnet according to said normal control conditions or said overriding control conditions depending on the operating condition of said third input terminal.

* * * * *